US007394999B2

(12) United States Patent
Zaima

(10) Patent No.: US 7,394,999 B2
(45) Date of Patent: Jul. 1, 2008

(54) IMAGE FORMING APPARATUS AND IMAGE CONTROL METHOD FOR CONTROLLING IMAGE DENSITY

(75) Inventor: Nobuhiko Zaima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 299 days.

(21) Appl. No.: 11/219,734

(22) Filed: Sep. 7, 2005

(65) Prior Publication Data

US 2006/0056864 A1 Mar. 16, 2006

(30) Foreign Application Priority Data

Sep. 13, 2004 (JP) ..... 2004-266122

(51) Int. Cl.

| | |
|---|---|
| ***G03G 15/00*** | (2006.01) |
| ***G03G 15/02*** | (2006.01) |
| ***G03G 15/043*** | (2006.01) |
| ***G03G 15/08*** | (2006.01) |
| ***G03G 15/16*** | (2006.01) |

(52) U.S. Cl. ..... 399/27; 399/30; 399/49; 399/50; 399/51; 399/66

(58) Field of Classification Search ..... 399/27, 399/30, 49–51, 53, 58, 66

See application file for complete search history.

(56) References Cited

U.S. PATENT DOCUMENTS 5,678,131 A * 10/1997 Alexandrovich et al. ..... 399/58

6,115,561 A * 9/2000 Fukushima ..... 399/49

FOREIGN PATENT DOCUMENTS

| | | |
|---|---|---|
| JP | 6-11965 | 1/1994 |
| JP | 10-16304 | 1/1998 |

* cited by examiner

*Primary Examiner*—William J. Royer
(74) *Attorney, Agent, or Firm*—Fitzpatrick, Cella, Harper & Scinto

(57) ABSTRACT

An image forming apparatus includes devises for performing a detection method which detects an image characteristic of an image formed on an image bearing member; a first control method which controls a toner concentration in a developer, based on a detection result by the detection method, of an image characteristic of a first reference image for a first control for controlling the toner concentration; a second control method which controls an image parameter, different from the toner concentration, thereby controlling an image density, based on a detection result of an image characteristic of a second reference image for a second control, different from the first reference image; and a correction method which receives detection results of both image characteristics of the first and second reference images, and which, based on the detection result of the image characteristic of either of the reference images for the first and second controls, corrects the other control.

18 Claims, 7 Drawing Sheets

IMAGE FORMING APPARATUS AND IMAGE CONTROL METHOD FOR CONTROLLING IMAGE DENSITY

BACKGROUND OF THE INVENTION

1. Field of the Invention

The present invention relates to an image forming apparatus such as a copying apparatus or a printer, utilizing an electrophotographic process or an electrostatic recording process for obtaining an image by developing an electrostatic image formed on an image bearing member with a developer, and an image control method in such image forming apparatus.

2. Related Background Art

It is already known, for example in an image forming apparatus of electrophotographic process, to develop a latent image formed on an image bearing member with a developer in a developing device, thereby rendering it visible as a toner image. Also there is known a developing device utilizing a two-component developer containing toner and carrier.

In a developing device utilizing a two-component developer, it is important to maintain a constant toner concentration, namely a constant mixing ratio T/(T+C) of the toner (T) and the carrier (C) (hereinafter also referred to as T/(T+C) ratio. For this reason, an image forming apparatus employing the two-component developing method is equipped with an auto toner replenisher (ATR). As a toner concentration control method in such an auto toner replenisher, namely a method of measuring and controlling the T/(T+C) ratio of the developer, there is employed a method of forming a patch image which is an image pattern of a reference density for controlling the toner concentration (hereinafter also called "toner concentration control patch"), on the image bearing member, and detecting the T/(T+C) ratio from the measurement of the image density of the patch (such toner concentration control method being hereinafter referred to as "patch detection method").

For example in an image forming apparatus for forming full-color images at a high speed, a patch image formation and a density detection for each image in the continuous image formation will lower the image output speed and will promote stains in the apparatus. However, in a digital image forming apparatus, it is possible, in a continuous image forming operation, to estimate the toner consumption by adding image information signals and to replenish the toner in succession, based on the estimated consumption amount (such toner concentration control method being hereinafter called "video count method"). Such video count method is used in combination with the patch detection method (for example cf. Japanese Patent Application Laid-open No. H06-011965).

Also in an image forming apparatus of an electrophotographic method, a density of an output image may become higher or lower than an expected density because of various factors including, for example, environmental conditions such as temperature and humidity at the printing operation, a temperature change or a deterioration in a photosensitive drum or a fixing device of the printer, and a residual toner amount. Such phenomenon is particularly conspicuous in an image of an intermediate density level. In order to compensate such fluctuation in the output density characteristics caused by a variation in the image output conditions and to obtain an appropriate density in the output image, there is executed a control on image parameters (image density correction control), which is different from the toner concentration in the developer. As such image density correction control, there is known, for example, a following density correction characteristic control (γLUT control), which corrects density correction characteristics (γLUT) for correcting an image information signal that is used for forming the electrostatic image. More specifically, there is formed a patch image which is an image pattern corresponding to an image signal of a predetermined density level (such patch image being hereinafter also called "density correction characteristic controlling patch"), and a density of such patch image is measured. Then the measured density of the patch image is compared with a standard density at a corresponding density level. Then a density correction table (γLUT) for correcting the density level of the image data is so prepared that the output density characteristics have a predetermined property (for example linearity) (for example cf. Japanese Patent Application Laid-open No. H10-16304).

However the toner concentration control and the density correction characteristic control are independent controls as described above and have been executed independently for stabilizing the image density.

Therefore, in an image forming apparatus equipped with both of the toner concentration control and the density correction characteristic control, both controls may compete with each other to result in an excessive control thereby leading to an instability in the image density. For example, in case the toner concentration control and the density correction characteristic control form patch images (toner concentration controlling patch and density correction characteristic controlling patch) almost at the same time and such patch images are judged to have a low density (low toner deposition amount), the toner concentration control executes a toner replenishment while the density correction characteristic control makes a correction on the density correction characteristics (γLUT) to elevate the density, whereby the image density may become excessively high as a result.

It is ideal to at first execute the toner concentration control to obtain an appropriate T/(T+C) ratio and then to execute the density correction characteristic control, but such sequence requires a complex control and a long control time, thereby significantly deteriorating the productivity of the image forming apparatus.

Consequently, there are required an image forming apparatus and an image control method, capable of correlating the toner concentration control and an image parameter control different from the toner concentration control (such as density correction characteristic control) thereby maintaining the image density in a simpler and shorter control.

SUMMARY OF THE INVENTION

An object of the present invention is to provide an image forming apparatus and an image control method capable of stably maintaining an image density by a simpler and shorter control.

The aforementioned object can be attained by an image forming apparatus and an image control method of the present invention. More specifically, the present invention is to provide an image forming apparatus capable of forming, according to an image information signal, an image on an image bearing member with a developer containing a toner, and outputting the image by a transfer onto a recording material, the apparatus including detection means which detects an image characteristic of the image formed on the image bearing member; first control means which controls a toner concentration in the developer, based on a detection result by the detection means, of an image characteristic of a first reference image for a first control for controlling the toner concentration in the developer; second control means which controls an image parameter, different from the toner concentration in the developer, thereby controlling an image density, based on a detection result by the detection means, of an image characteristic of a second reference image for a second control, different from the reference image for the first control; and correction means which receives detection results of both image characteristics of the first and second reference images, and which, based on the detection result of the image characteristic of either of the reference images for the first and second controls, corrects the other control.

In another aspect, the present invention provides an image control method for controlling an image density characteristic based on a detection result of an image characteristic of a reference image, formed on an image bearing member by a developer containing a toner according to an image information signal, the method including a step of detecting an image characteristic of a first reference image formed on the image bearing member for a first control for controlling a toner concentration in the developer; a step of detecting an image characteristic of a second reference image, formed on the image bearing member and different from the first reference image, for a second control for controlling an image parameter different from the toner concentration in the developer thereby controlling the image density; and a step, after the detection of both image characteristics of the first and second reference images, of correcting, according to a detection result of the image characteristic of either of the reference images for the first and second controls, the other control.

DETAILED DESCRIPTION OF THE PREFERRED EMBODIMENTS

In the following, an image forming apparatus and an image control method of the present invention will be clarified in detail.

Embodiment 1

[Configuration and Operation of Image Forming Apparatus]

At first there will be explained an entire configuration and an operation of an image forming apparatus of the present invention.

Figure 1:
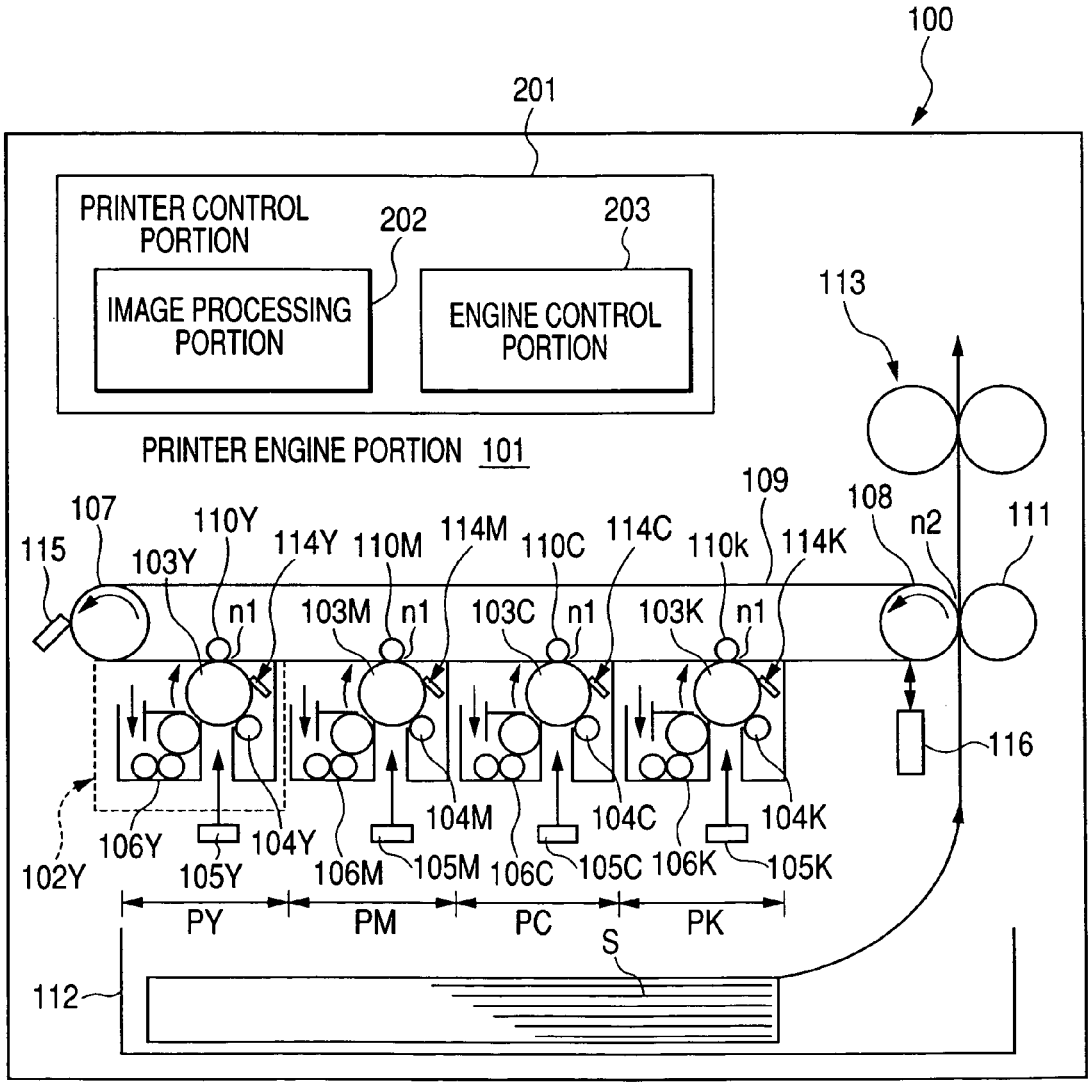
FIG. 1 is a schematic view showing a configuration of an embodiment of an image forming apparatus in which the present invention is applicable.

FIG. 1 is a schematic view showing the configuration of an image forming apparatus 100 of the present invention. The image forming apparatus 100 of the invention is a color laser beam printer capable, by an electrophotographic process according to an image information signal from an external equipment such as a host computer (personal computer) communicably connected with a main body of the image forming apparatus 100, of forming a full-color image on a recording material (a recording paper, a plastic film or a cloth).

As shown in FIG. 1, the image forming apparatus 100 is provided with a printer engine portion 101 and a printer control portion 201. The printer engine portion 101 includes, as image forming means, plural image forming stations PY, PM, PC, PK for forming images of respectively different colors (yellow (Y), magenta (M), cyan (C) and black (K) in the present embodiment). As the image forming stations PY, PM, PC, PK are substantially the same in configuration and operation except for a difference in developed color, such stations PY, PM, PC, PK will be explained collectively in the following, omitting suffixes Y, M, C and K attached to the symbols in the drawing for identifying the image forming stations PY, PM, PC, PK, unless particular distinction is required.

The printer engine portion 101 is provided with a process cartridge 102 integrally including a cylindrical electrophotographic photosensitive member 103 (hereinafter called "photosensitive drum") serving as a first image bearing member on which an electrostatic image is to be formed; a primary charger 104 serving as charging means for charging the photosensitive drum 103; a developing device 106 serving as developing means which develops an electrostatic image formed on the photosensitive drum 103 with a developer; and a photosensitive drum cleaner 114 as cleaning means which cleans the surface of the photosensitive drum 103. The process cartridge 102 is detachably mounted on the main body of the image forming apparatus 100, by means of mounting means (not shown) such as a mounting guide or a positioning member provided in the main body of the image forming apparatus 100. Thus, the image forming apparatus 100 of the present embodiment is a 4-drum full-color printer of tandem type, in which four process cartridges 102Y, 102M, 102C, 102K are serially arranged. Opposed to the photosensitive drums 103 of the image forming stations PY, PM, PC, PK, there is provided an intermediate transfer belt (intermediate transfer member) 109 serving as a second image bearing member for receiving transfers of the toner images from the respective photosensitive drums 103. Also in each image forming station PY, PM, PC, PK, a primary transfer charger 110 serving as primary transfer means is provided in an opposed relationship to the photosensitive drum 103. Further, each image forming station PY, PM, PC, PK is provided with a laser beam scanner (exposure apparatus) 105 as exposure means.

The photosensitive drum 103 is provided with amorphous silicon, selenium or an OPC on the surface thereof and is rotated in a direction indicated by an arrow. The photosensitive drum 103 is at first uniformly charged by the primary charger 104 to which a charging bias (charging voltage) is applied, and is then scan exposed with a laser beam by the exposure apparatus 105 based on image drawing data as will be explained later, whereby an electrostatic image (latent image) is formed on the photosensitive drum 103.

The latent image formed on the photosensitive drum 103 is subjected, in the developing device 106, to a reversal development by a two-component developer formed by mixing a non-magnetic toner (toner) and a magnetic carrier (carrier), whereby a toner image is formed on the photosensitive drum 103. The reversal development means a developing method in which a latent image is formed as an exposed area of the photosensitive member on the surface of the photosensitive drum 103, and a toner charged in a polarity the same as that of the latent image is deposited in such area thereby forming a visible image. In the developing device 106, a cylindrical member is employed as a developer carrying member, inside which a magnet roll as magnetic field generating means is fixedly provided, and the developer is carried on such developer carrying member to a position opposed to the photosensitive drum 103 whereby the toner contained in the developer is supplied to the photosensitive drum 103 according to the electrostatic image. Usually a predetermined developing bias (developing voltage) is applied to the developer carrying member in order to form a potential difference to the photosensitive drum 103 at least at the developing operation, and, under the function of an electric field formed in a space to the photosensitive drum 103, the toner in the developer is transferred to an image area of the electrostatic image.

The intermediate transfer belt 109, positioned in an opposed manner to the photosensitive drums 103 in the respective image forming stations PY, PM, PC, PK, are supported between rollers 107, 108 and is endlessly driven in a direction indicated by an arrow. The toner image formed on the photosensitive drum 103 is transferred, at a primary transfer portion n1 where the primary transfer charger 110 is opposed to the photosensitive drum 103 across the intermediate transfer belt 109, onto the intermediate transfer belt 109 by the function of a primary transfer bias (transfer voltage) applied to the primary transfer charger 110.

The toner image transferred onto the intermediate transfer belt 109 is transferred, at a secondary transfer portion n2 where the roller 108 and a secondary transfer charger 111 are mutually, onto a recording material S by the function of a secondary transfer bias (transfer voltage) applied to the secondary transfer charger 111. The recording material S is supplied from a cassette 112 serving as a recording material container and is conveyed to the secondary transfer portion n2 in synchronization with the toner formed on the intermediate transfer belt 109, by recording material conveying means such as a recording material feed roller and registration rollers (not shown).

The recording material S bearing the transferred toner image is conveyed to a fixing device 113, which executes a fixation of the toner image onto the recording material S. Then the recording material S bearing the fixed toner image is discharged to the exterior of the image forming apparatus 100.

On the other hand, a residual toner remaining on the photosensitive drum 103 after the primary transfer step is removed by a photosensitive drum cleaner 114. Also a residual toner remaining on the intermediate transfer belt 109 after the secondary transfer step is removed by a belt cleaner 115.

The toner is replenished from a toner hopper 117 (FIG. 2) into the developing device 106, by a carrying screw 118 (FIG. 2) provided in the toner hopper 117. A replenishing amount of the toner is so controlled as to maintain an appropriate image density by an auto toner replenisher (ATR) to be explained later in more detail.

The image forming apparatus 100 of the present embodiment is also provided, as detection means for detecting an image characteristic of an image formed on the image bearing member, a density sensor 116 serving as detection means which detects a toner amount (density) of an image pattern on the intermediate transfer belt 109. In the present embodiment, the density sensor 116 is an optical sensor constituted of a light source such as a light-emitting diode (LED), and a photoelectric conversion element (photosensor) such as a photodiode (PD).

Figure 2:
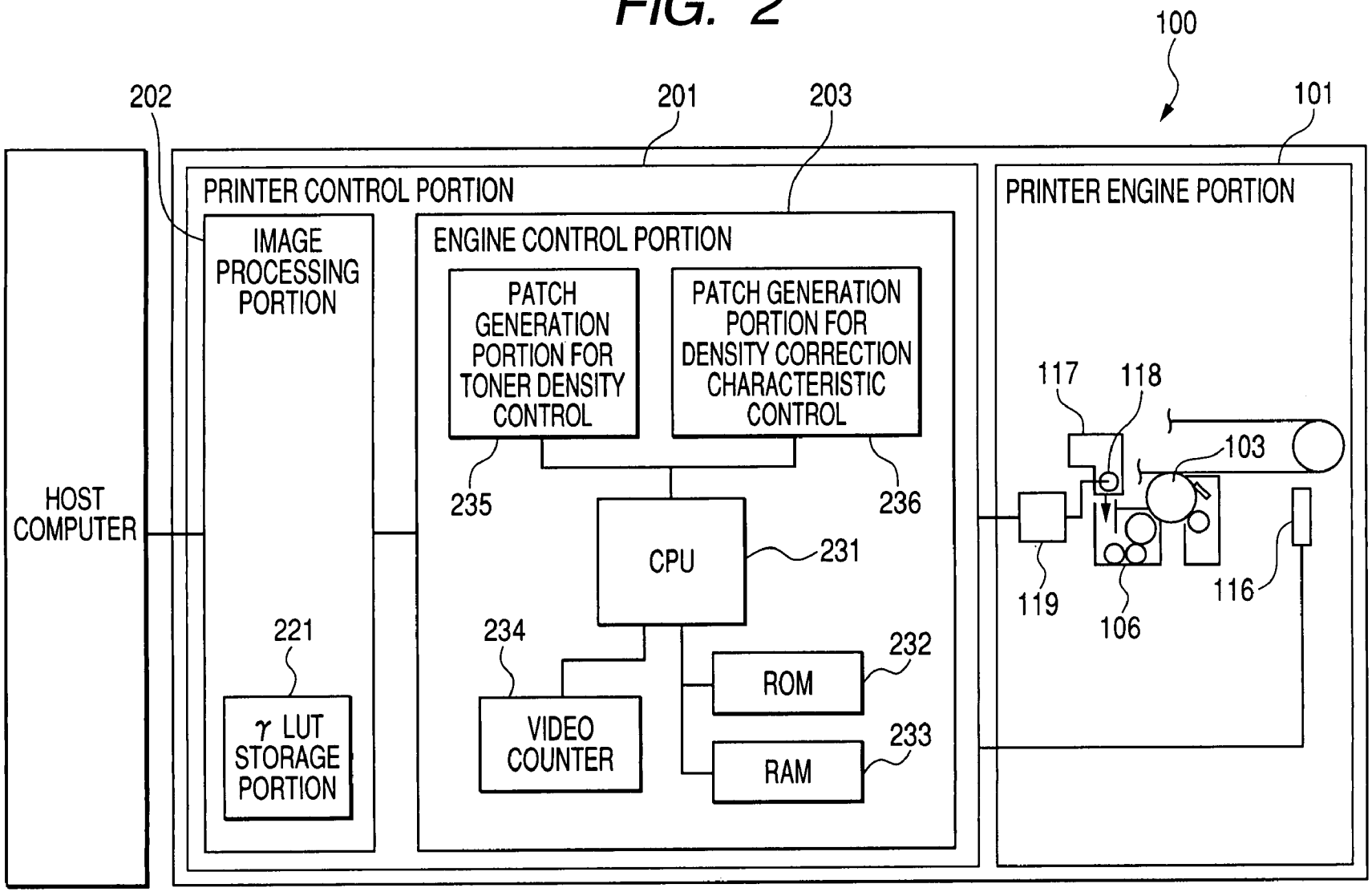
FIG. 2 is a schematic block diagram of an embodiment of a toner concentration control and a density correction characteristic control (γLUT control) of the present invention.

FIG. 2 is a schematic control block diagram of the image forming apparatus 100 of the present embodiment. Referring also to FIG. 2, the host computer generates "image data" including color information, character information, graphic information raster images, control information etc. (including PDL data), and transmits the same to a printer control portion 201, which includes an image processing portion 202, and an engine control portion 203. The image processing portion 202 receives "image data" from the host computer and converts (develops) such "image data" into "drawing data (raster image data)". The engine control portion 203 causes a printer engine portion 101 to form an output image based on the "drawing data" supplied from the image processing portion 202.

More specifically, the image processing portion 202 receives the "image data" from the host computer and in succession converts print information such as color information, character information, graphic information, raster images etc. contained in the "image data" into "intermediate information (hereinafter also called "object"). In case the print information is gradation data such as a gray level setting, a color level setting or a multi-value raster image, a density level is corrected utilizing a density correction table (LUT) prepared in a density correction characteristic control (LUT control) to be explained later in more detail. Also "raster image data" are generated, based on the "object". In this operation a pseudo intermediate tone process is applied to the image to be drawn. The "raster image data" are supplied as "drawing data" to the engine control portion 203.

The density level correction by γLUT is not limited at the generation of "object" but may be executed after the image data in the object unit are developed into "raster image data".

The engine control portion 203, based on the "drawing data" supplied from the image processing portion 202 as explained above, drives the exposure apparatus 105 to emit a laser beam thereby forming an electrostatic latent image on the photosensitive drum 103.

The engine control portion 203 executes a comprehensive control of the operation of the apparatus 100. The engine control portion 203 is provided with a CPU 231 as a central control device, which is connected to a ROM 232 storing programs to be executed by the CPU 231 and various data, and to a RAM 233 to be used as a work memory. The CPU 231 causes a sequential operation of the image forming apparatus 100 according to data and programs stored in the ROM 232 and the RAM 233. In the present embodiment, the engine control portion 203 is further provided with a video counter 234 for counting a level of drawing data for each pixel, a toner concentration controlling patch generation portion 235 and a density correction characteristic control patch generation portion 236, serving as reference image generation means (reference image generation circuits), as will be explained later in more detail.

The engine control portion 203 is connected to the image processing portion (video controller) 202. As explained in the foregoing, the image processing portion 202 receives "image data" from an external equipment such as a host computer communicably connected to the main body of the image forming apparatus 100, then converts such signal into "drawing data" and transmits the same to the CPU 231 of the engine control portion 203. The CPU 231 controls the functions of various portions of the image forming apparatus 100 according to such "drawing data". The image processing portion 202 is further provided with a γUT memory portion (or a γLUT storage portion) 221 for storing a γLUT in the density correction characteristic control to be explained later.

[Toner Concentration Control]

In the following, there will be explained a toner concentration control.

In the present embodiment, the image forming apparatus 100 executes a toner concentration control by combining a video count method and a patch detection method.

At first, in order to control a toner amount to be replenished in the developing device 106 by a video count method, a level of the drawing data in the image processing portion 202 is counted for each pixel of each color. A cumulative signal (cumulative video count) for the video count for each color in an image (image for a single recording material S) corresponds to a toner amount consumed in the developing device 106 for forming such image.

The aforementioned cumulative video count for each color is transmitted, for each image formation, to the CPU 231 of the engine control portion 203 and is stored in the RAM 233.

The toner concentration control is executed for the developing device 106 of each image forming station PY, PM, PC, PK, and is substantially same for the developing devices 106. Therefore, in the following, the operations of the toner concentration control will be explained with reference to the developing device 106 of a certain image forming station, unless specified otherwise.

The CPU 231 of the engine control portion 203 calculates, based on the cumulative video count, a rotation drive time of the carrying screw 118 provided in the toner hopper 117, required for feeding the toner from the toner hopper 117 to the developing device 106 in an amount matching a toner amount consumed in the developing device 106. Then the CPU 231 of the engine control unit 203 controls a driving circuit for a motor 119 (FIG. 2) ("screw motor") for the carrying screw 118, thereby driving the screw motor 119 for thus calculated time.

Therefore, a larger or smaller cumulative video count respectively requires a longer or shorter driving time of the screw motor 119.

The power of the screw motor 119 is transmitted through a gear train to the carrying screw 118, which thus feeds toner from the toner hopper 117 to the developing device 106. In the present embodiment, the toner replenishment is executed after the development for every image.

The aforementioned toner supply to the developing device 106 according to the drawing data is not a toner supply based on the detection of an actual toner concentration in the developer but is a supply by estimation. Therefore, the toner concentration in the developer contained in the developing device 106 shifts from a specified value, in case of a change in the toner replenishment amount from the toner hopper 117 to the developing device 106, or a deviation of the toner consumption amount in the developing device 106 from the estimated amount.

In the present embodiment, therefore, the toner replenishing operation by the aforementioned video count method is corrected by a patch detection method, for every predetermined number (N) of image outputs.

More specifically, in the present embodiment, after image formations for output prints of a predetermined number (N) and before the start of an image formation for next print, a patch image ("toner concentration control patch") is formed on the intermediate transfer belt 109, as an image pattern or a reference density (reference image) for the toner concentration control. Then a density (toner amount) of such patch image is measured to determine an actual toner concentration in the developer contained in the developing device 106. Then, based on the result of measurement, there is discriminated whether the toner is over-replenished to the developing device 106 by the toner replenishing operation during the predetermined output number (N), and, if not, the carrying screw 118 of the toner hopper 117 is rotated by a necessary number of turns to supply the developing device 106 with the toner of a deficient amount from the toner hopper 117. Also a correction is made on the toner replenishing amount by the video count method, thereby correcting the toner replenishing amount for the image formation for a next print. In case the toner is replenished in an appropriate amount, the deficient amount of the toner is zero, so that the correction on the toner replenishing amount by the video count method is not executed. Also in case an over-replenishment is identified, a correction is made on the toner replenishing amount by the video count method, thereby correcting the toner replenishing amount for the image formation for a next print.

In more detail, the photosensitive drum 103 is scanned by the laser of the exposure apparatus 105 which is activated by a patch image signal, having a signal level corresponding to a predetermined concentration. The patch image signal is generated by a toner concentration control patch signal generation portion 235 provided as reference image generation means in the engine control portion 203, and is transmitted to the CPU 231 of the engine control portion 203. The toner concentration control patch generation portion 235 generates, according to a program stored in the ROM 232, a patch image signal and transmits it to the CPU 231. The CPU 231 of the engine control portion 203 drives the exposure apparatus 105 according to the patch image signal supplied from the toner concentration control patch generation portion 235, whereby an electrostatic image of a patch image corresponding to the aforementioned predetermined concentration is formed on the photosensitive drum 103.

Figure 3:
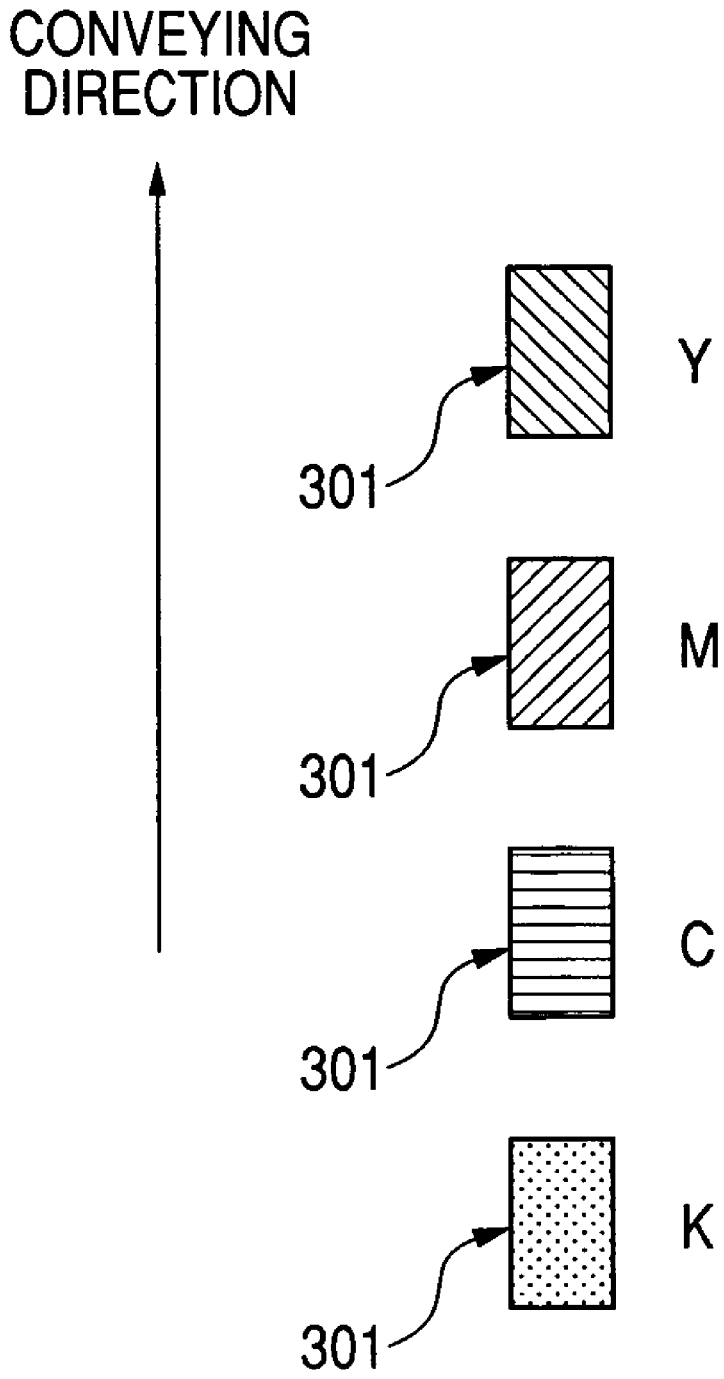
FIG. 3 is a schematic view showing a sample of patch images for toner concentration control.

The electrostatic image is developed by the developing device 106 according to predetermined developing conditions, and a patch image formed on the photosensitive drum 103 is transferred onto the intermediate transfer belt 109. Thus, as schematically shown in FIG. 3, a patch image 301 is formed on the intermediate transfer belt 109. In the present embodiment, the toner concentration control patches for the respective colors are formed in synchronization, for every predetermined number (N) of image outputs.

The patch image 301 formed on the intermediate transfer belt 109 is irradiated by a light from the light source of the density sensor 116, and a reflected light is received by the photoelectric conversion element, of which output signal corresponds to a density (toner deposition amount) of the patch image. Therefore, the output signal of the photoelectric conversion element corresponds to an actual toner concentration in the two-component developer in the developing device 106. Such output of the photoelectric conversion element of the density sensor 116 is entered into the CPU 231 of the engine control portion 203.

On the other hand, the ROM 232 of the engine control portion 203 stores a reference signal corresponding to a specific toner concentration in the developer. The CPU 231 of the engine control portion 203 compares the output signal of the photoelectric conversion element and the reference signal, thereby forming a signal indicating whether the actual toner concentration in the developer contained in the developing device 106 is equal to or higher than the specified value, or lower than that.

According to such signal indicating the result of comparison, the CPU 231 of the engine control portion 203 executes a following control.

At first, the actual toner concentration detected by the density sensor 116 is the same as the specified toner concentration, there is executed a following operation. The CPU 231 of the engine control portion 203 cancels the cumulative video count stored in the video counter 234, and executes a toner replenishing operation for a next image formation by the video count method as explained before.

Then, in case the actual toner concentration detected by the density sensor 116 is smaller than the specified toner concentration, the carrying screw 118 of the toner hopper 117 is activated so as to supply the developing device 106 with the toner of the deficient amount. More specifically, the CPU 231 of the engine control portion 203 calculates a deficient amount of toner, based on the signal from the density sensor 116, and calculates a rotation time of the carrying screw 118 required for supply to the developing device 106. Then the CPU 231 of the engine control portion 203 drives the screw motor 119 for such rotation time. Also in this case, the CPU 231 of the engine control portion 203 corrects a next toner replenishing operation by the video count method in the following manner. In addition to the supply of the deficient toner amount as described above, since such deficient toner amount M has been generated during N image formations, the CPU 231 of the engine control portion 203 calculates a deficient toner amount (M/N) for each image formation. Then the CPU 231 of the engine control portion 203 calculates a correction coefficient utilizing the cumulative video count and the deficient toner amount (M/N). Thus the CPU 231 calculates a video count V2 corresponding to the deficient toner amount (M/N), then, utilizing the cumulative video count V1 and the calculated video count V2, calculates a correction coefficient (for example (V1+V2)/V1) and stores it in the RAM 233 of the engine control portion 203. This correction coefficient is used for correcting the cumulative video count counted in a next print.

Then, in case the actual toner concentration detected by the density sensor 116 is larger than the specified toner concentration, the CPU 231 of the engine control portion 203 executes a following correction on the next toner replenishing operation by the video count method. The CPU 231 of the engine control portion 203 calculates an excessive toner amount M' in the developer. Since such excessive toner amount M' has been generated during N image formations, the CPU 231 of the engine control portion 203 calculates an excessive toner amount (M'/N) for each image formation. Then the CPU 231 of the engine control portion 203 calculates a correction coefficient utilizing the cumulative count and the excessively toner amount (M'/N). Thus the CPU 231 calculates a video count V3 corresponding to the excessive toner amount (M'/N), then, utilizing the cumulative video count V1 and the calculated video count V3, calculates a correction coefficient (for example (V1−V3)/V1) and stores it in the RAM 233 of the engine control portion 203. This correction coefficient is used for correcting the cumulative video count counted in a next print.

In an image formation for a next print, a cumulative video count V4 counted on the drawing data, supplied from the image processing portion 202, by the video counter 234 is stored in the RAM 233, and the CPU 231 of the engine control portion 203 calculates a toner replenishing time per an image (image for a recording material S), corresponding to the cumulative video count V4 multiplied by the aforementioned correction coefficient. Then the CPU 231 of the engine control portion 203 executes a toner replenishment by driving the carrying screw 118 of the toner hopper 117 by the calculated time after each image formation.

As explained in the foregoing, a correcting term is added to the toner replenishing amount of the video count method, thereby changing the toner replenishing amount for every preset number (N), in response to a deviation in the toner replenishing amount or in the toner consumption amount from estimated value, whereby the toner concentration in the developing device 106 can be stabilized.

In the present embodiment, components used for toner replenishment to the developing device 106 by the video count method and the patch detection method as explained constitute an auto toner replenisher, namely first control means which executes a control (first control) of the toner concentration in the developer, based on the result of detection, by the toner density sensor 116, of the image characteristic (toner deposition amount) of the toner concentration control patch formed on the photosensitive drum 103. Thus, in the present embodiment, an auto toner replenisher is constituted of the density sensor 116, the toner hopper 117, the video counter 234, the toner concentration control patch generating portion 235, the CPU 231 and the components used for forming the patch image in the printer engine portion 101.

[Density Correction Characteristic Control (γLUT Control)]

In the following there will be explained a density correction characteristic control.

The image forming apparatus 100 of the present embodiment executes a density correction characteristic control for controlling an image parameter, different from the toner concentration in the developer, in order to suppress a variation in the output density characteristic, resulting from a fluctuation in image output conditions, for example environmental conditions such as temperature and humidity at the printing operation and status of the components in the image forming apparatus 100.

For an every predetermined number (N) of image outputs, the engine control portion 203 forms, on the intermediate transfer belt 109, a patch image ("density correction characteristic control patch") for density correction characteristic control, which is an image pattern (reference image) of a predetermined drawing data level, and such patch is detected by the density sensor 116. Then the result of measurement by the density sensor 116 is compared with a standard density at a density level of the drawing data corresponding to such measured patch image. Based on the result of such comparison, the engine control portion 203 prepares a density correction table (γLUT) defining a density conversion rule in which a density level of the image data before the density correction and a density of the output image assume a predetermined relationship (linear relationship in the present embodiment).

In the present embodiment, the density level is set within a range from 0 (minimum density level) to 255 (maximum density level). However the present invention is limited to such set range of the density level as in the present embodiment, but the set range can be suitably changed according to the image forming apparatus employed for executing the present invention.

In the following, a more detailed explanation will be given on the preparation process of the γLUT in the present embodiment.

In the present embodiment, the density level setting range 0-255 is divided into four regions. In the present embodiment, density levels 0-63 are taken as a level region 1, density levels 64-127 as a level region 2, density levels 128-191 as a level region 3, and density levels 192-255 as a level region 4.

Then, according to a γLUT preparation program, the printer engine portion 101 prepares density correction characteristic controlling patches corresponding a density level 63

(level 1), a density level 127 (level 2), a density level 191 (level 3) and a density level 255 (maximum density level). The densities of the patch images are measured by the density sensor 116, and a γLUT is prepared (or renewed) based on the relationship between the results of measurement for the respective levels and the standard densities.

In more detail, the density correction characteristic control patch generating portion 236, serving as reference image generating means provided in the engine control portion 203 generates, according to a program stored in the ROM 232, patch image signals of the level 1, level 2, level 3 and maximum density mentioned above, and transmits them to the CPU 231 of the engine control portion 203, which drives the exposure apparatus 105 according to the patch image signals supplied from the density correction characteristic control patch generating portion 236, whereby electrostatic images of patch images corresponding to the respective levels are formed on the photosensitive drum 103. These electrostatic images are developed by the developing device 106 according to predetermined developing conditions, and the patch images thus formed on the photosensitive drum 103 are transferred onto the intermediate transfer belt 109.

The patch images formed on the intermediate transfer belt 109 are irradiated by a light from the light source of the density sensor 116, and a reflected light is received by the photoelectric conversion element, of which output signal corresponds to a density (toner amount) of the patch image. The output of the photoelectric conversion element is entered into the CPU 231 of the engine control portion 203.

In the present embodiment, the CPU 231 of the engine control portion 203 normalizes the densities (measured values) of the patch images corresponding to the density level 63 (level 1), density level 127 (level 2), and density level 191 (level 3) by a density (measure value) of a patch image corresponding to the density level 255 (maximum density level). In the present embodiment, standard densities respectively corresponding to the density levels 0, 63, 127, 191 and 255 are taken as 0, 0.25, 0.5, 0.75 and 1. The CPU 231 of the engine control portion 203 compares such standard density and the density (measured value) normalized as explained above, and prepares a γLUT based on the result of comparison. The standard densities are stored in the ROM 232 of the engine control portion 203.

Figure 4:
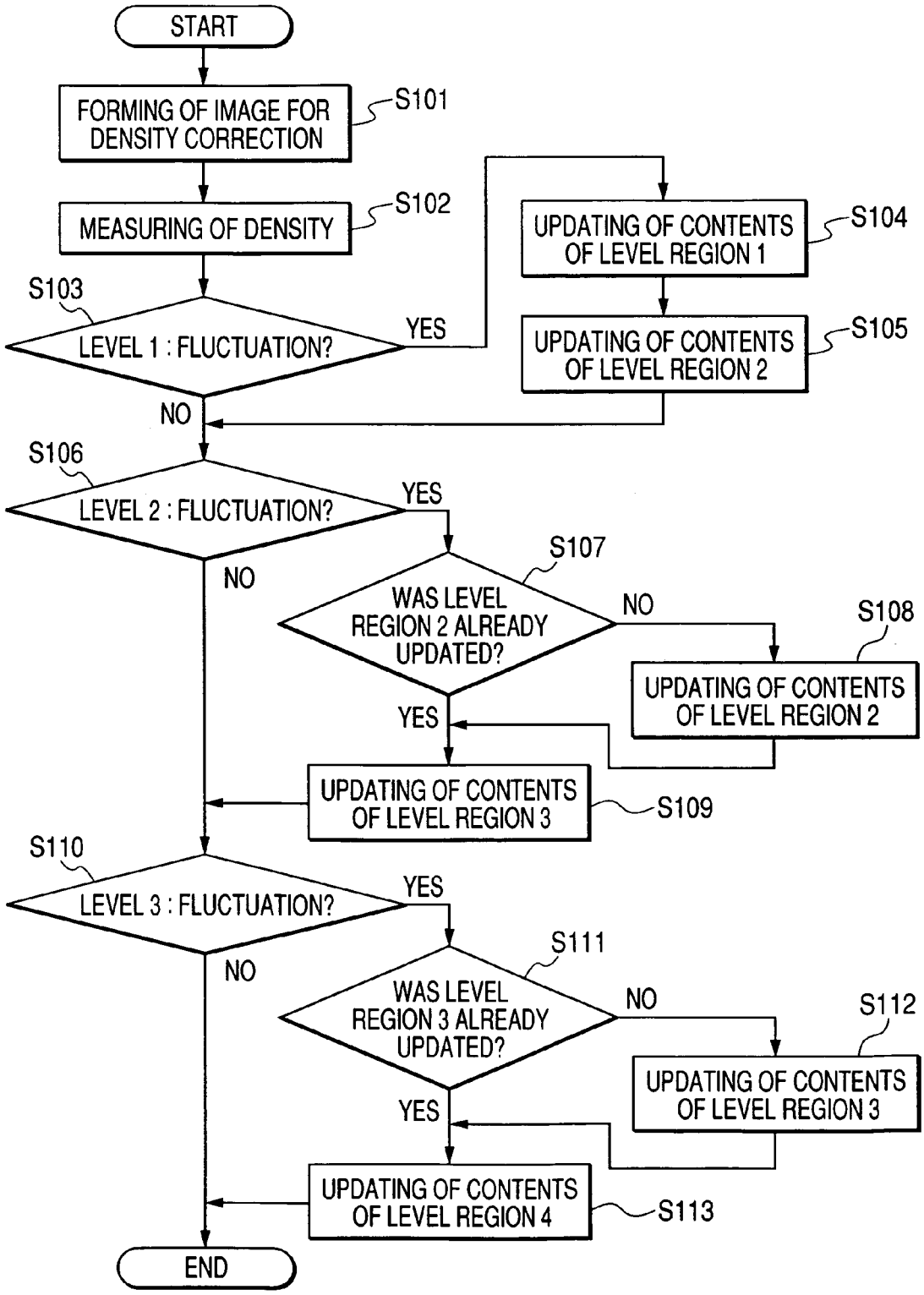
FIG. 4 is a flow chart of the density correction characteristic control (γLUT control)

In the following, a specific process flow will be explained with reference to FIG. 4.

At first, in a step S101, the printer engine portion 101 forms patch images corresponding to the levels 1-3 and the maximum density level. In a step S102, the densities of the patch images are measured by the density sensor 116, and the densities of the patch images corresponding to the levels 1-3 are normalized by the density of the patch image of the maximum density level.

A step S103 discriminates whether a variation is present in the output density at the level 1, by comparing the normalized density of the patch image of the level 1 with a standard density 0.25 thereof. The sequence proceeds to a step S104 in case the output density shows a variation, or to a step S105 in case the output density does not show a variation (or in case of a slight variation not exceeding a predetermined value).

The step S104 renews the content of the level region 1 in the γLUT, then the step S105 renews the content of the level region 2 in the γLUT, and the sequence proceeds to the step S106.

The step S106 discriminates whether a variation is present in the output density at the level 2, by comparing the normalized density of the patch image of the level 2 with a standard density 0.5 thereof. The sequence proceeds to the step S107 in case the output density shows a variation, or to the step S110 in case the output density does not show a variation (or in case of a slight variation not exceeding a predetermined value).

The step S107 discriminates whether the content of the level region 2 of the γLUT is already renewed (S105), and, if renewed, the sequence directly proceeds to the step S109. On the other hand, if not renewed, the sequence proceeds to the step S108 for renewing the content of the level region 2 of the γLUT and then proceeds to the step S109, which renews the content of the level region 3 of the γLUT.

The step S110 discriminates whether a variation is present in the output density at the level 3, by comparing the normalized density of the patch image of the level 3 with a standard density 0.75 thereof. The sequence proceeds to the step S111 in case the output density shows a variation, or the process is terminated in case the output density does not show a variation (or in case of a slight variation not exceeding a predetermined value).

The step S111 discriminates whether the content of the level region 3 of the γLUT is already renewed (S109), and, if renewed, the sequence directly proceeds to the step S113. On the other hand, if not renewed, the sequence proceeds to the step S112 for renewing the content of the level region 3 of the γLUT and then proceeds to the step S113, which renews the content of the level region 4 of the γLUT.

Figure 5:
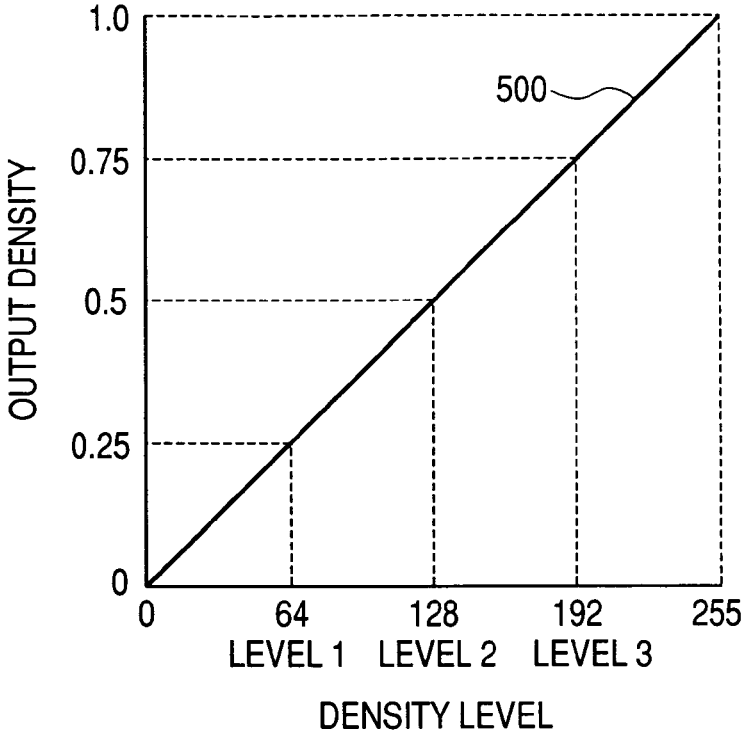
FIG. 5 is a chart showing an output density characteristic in an ideal state.

FIG. 5 shows a relationship between the density levels of the image data and the output densities (output density characteristics) in an ideal state. In an ideal state, as shown in FIG. 5, a characteristic curve 500 becomes linear whereby the output density characteristic has a linearity. The printer maintains the characteristic shown in FIG. 5 in a normal state. However, such characteristic shows a variation by fluctuations in the output conditions, such as a fluctuation in temperature or humidity, or a temperature change or a deterioration in the photosensitive drum 103, the developer, or the fixing device 113.

Figure 6:
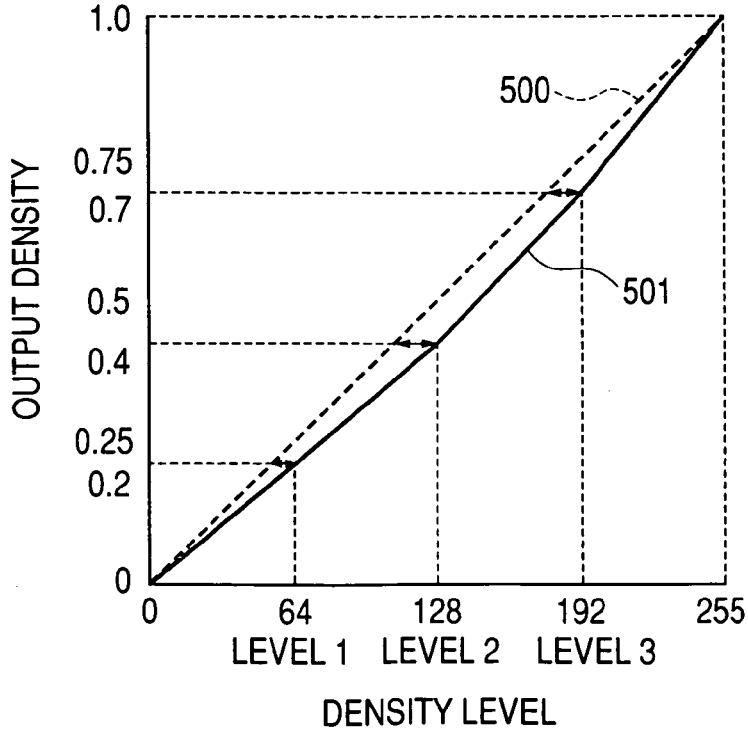
FIG. 6 is a chart showing an output density characteristic under a variation in an output condition.

FIG. 6 shows an example of a variation in the output density characteristic by a fluctuation in the output conditions, wherein a characteristic curve 501 shows an output density characteristic in which the normalized output density is 0.2 at the level 1, 0.4 at the level 2 and 0.7 at the level 3.

Therefore, in the γLUT preparation process, a γLUT is prepared to correct the density level of the image data in such a manner that the characteristic curve 501 coincides with the ideal characteristic curve 500.

Table 1 shows an example of γLUT, wherein a left column indicates a density level of image data (original image data) before the correction by the density correcting program, while a right column indicates a corrected value prepared (renewed) by the γLUT preparation process.

The CPU 231 of the engine control portion 203 prepares a γLUT as indicated in the right column of Table 1, according to a γLUT preparation program stored in the ROM 232. Thus prepared γLUT is stored in a γLUT memory portion 221 of the image processing portion 202. Then the image processing portion 202, referring to the γLUT stored in the γLUT memory portion 221 according to the density correction program, converts a density of the original image data for example of "64" into "77" and transfers to an object generation program.

TABLE 1

| Density level | Correction value |
|---|---|
| 0 | 0 |
| 1 | 1 |

TABLE 1-continued

| Density level | Correction value |
|---|---|
| 2 | 2 |
| . | . |
| . | . |
| . | . |
| 64 | 77 |
| 65 | 78 |
| . | . |
| . | . |
| . | . |
| 96 | 115 |
| 97 | 116 |
| 98 | 118 |
| 99 | 119 |
| . | . |
| . | . |
| . | . |
| 254 | 254 |
| 255 | 255 |

In the following, there will be explained a specific example of a process of renewing (corresponding to the step S105 or S108) the content a level region 2 (density levels 64-127) of the γLUT.

It is assumed, as shown in FIG. 6, that an output density at the level 1 (density level 63) is 0.2 and an output density at the level 2 (density level 127) is 0.4.

In such case, a difference 1 between the standard density 0.25 and the output density 0.2 at the level 1 is 0.25−0.2=0.05, and a difference 2 between the standard density 0.5 and the output density 0.4 at the level 2 is 0.5−0.4=0.1.

A correction value for the level 1 for correcting the characteristic indicated by the characteristic curve 501 according to γLUT for matching the characteristic curve, indicating the ideal output density characteristic becomes:

((difference 1)+(standard density of level 1))×(maximum density level)=(0.05+0.25)×255=76.5.

Also a correction value for the level 2 becomes:

((difference 2)+(standard density of level 2))×(maximum density level)=(0.1+0.5)×255=153.

Values 77 and 153, obtained by rounding these values, are written into the γLUT as the correction values respectively at the density levels 63 and 127. Also correction values for the density levels 64-126 are calculated on a line connecting the correction value of the density level 1 and that of the density level 2 and are written in the γLUT.

Correction values can be calculated in a similar manner for other level regions.

As explained in the foregoing, density correction characteristic controlling patches are prepared, and output densities thereof are measured by the density sensor 116 to renew the γLUT. In this manner, an ideal density characteristic can be maintained regardless of fluctuations in the output conditions.

In the foregoing description, the γLUT is renewed based on the output densities at three density levels. However, the present invention does not limit the number of the density levels used as the basis for renewing the γLUT, but can employ an arbitrary number of density levels as the basis. In such case, a process saving is possible by preparing reference images of a number smaller than a number of gradation levels that can be formed by the printer engine portion 101. A simplest control requiring a shortest time is possible with a single density level. Also the correcting method for the γLUT is not limited to a linear interpolation as described above, but may also be executed in a high-order interpolation. Also the correction of γLUT may be executed by selecting tables stored in advance.

In the present embodiment, components used for controlling (preparing or correcting) γLUT a density correction characteristic controlling apparatus, namely second control means which executes a control (first control) of the output image density characteristic by controlling a density correction characteristic (γLUT) as an image parameter different from the toner concentration in the developer, based on the result of detection, by the toner density sensor 116, of a density correction characteristic control patch, formed on the photosensitive drum 103 and different from the toner concentration control patch. Thus, in the present embodiment, a density correction characteristic controlling apparatus is constituted of the density sensor 116, the density correction characteristic control patch generating portion 236, the CPU 231 and the components used for forming the patch image in the printer engine portion.

[Toner Concentration Control and Density Correction Characteristic Control (γLUT Control)]

In the following there will be explained a relation of the toner concentration control and the density correction characteristic control featuring the present invention.

In the present embodiment, as explained in the foregoing, each of the toner concentration control and the density correction characteristic control executes control by forming am image pattern (toner concentration controlling patch or density correction characteristic controlling patch) for every predetermined number (N) of image outputs. In this manner, in the present embodiment, the toner concentration control and the density correction characteristic control have a same timing of activation and always simultaneously form the toner concentration controlling patch and the density correction characteristic controlling patch in succession on the intermediate transfer belt 109, for detection by the density sensor 116.

Also in the image control method of the present embodiment, after both the toner concentration controlling patch and the density correction characteristic controlling patch are detected according to the present invention, either detection result is used for correcting the other control.

In the present embodiment, after the patch images for both controls are read, the toner concentration control is executed as explained before. On the other hand, the density correction characteristic control utilizes the result of the toner concentration control.

More specifically, in the present embodiment, in case a toner concentration obtained by detecting the toner concentration control patch is significantly deviated from the specified toner concentration, the information obtained from the density correction characteristic control patch is not fed back to the γLUT (density correction characteristic or density correction table). Namely γLUT is not corrected in case the T/(T+C) ratio is significantly deviated from a predetermined value.

In this manner it is rendered possible to avoid the aforementioned competition of the toner concentration control and the density correction characteristic control.

Also in the present embodiment, after the patch images for both the toner concentration control and the density correction characteristic control are formed and detected, there is executed a discrimination whether or not to execute a feedback for correcting the γLUT, thereby reducing a control time and improving the productivity of the image forming apparatus 100.

More specifically, in case of at first executing a toner concentration control (formation and detection of the toner concentration control patch and calculation of toner concentration) and then judging and executing the activation of a density correction characteristic control in order to avoid the competition of both controls, the density correction characteristic control patch cannot be formed, at least while the toner concentration control patch moves from the developing position to the density sensor 116. In addition, there are required a calculation time for the toner concentration control and a time necessary for starting the image formation, specific to the apparatus, whereby an additional time becomes necessary for activating both controls.

A significant deviation in the toner concentration is caused by a variation in the environment or the like and does not occur normally, so that both controls are more likely to be activated. Therefore, a method of forming and detecting the patch images for both the toner concentration control and the density correction characteristic control in succession as in the present embodiment provides a higher productivity in a certain prolonged period.

The effect of simultaneous patch formation by the present embodiment becomes larger as the number of the density correction characteristic controlling patches is smaller.

Figure 7:
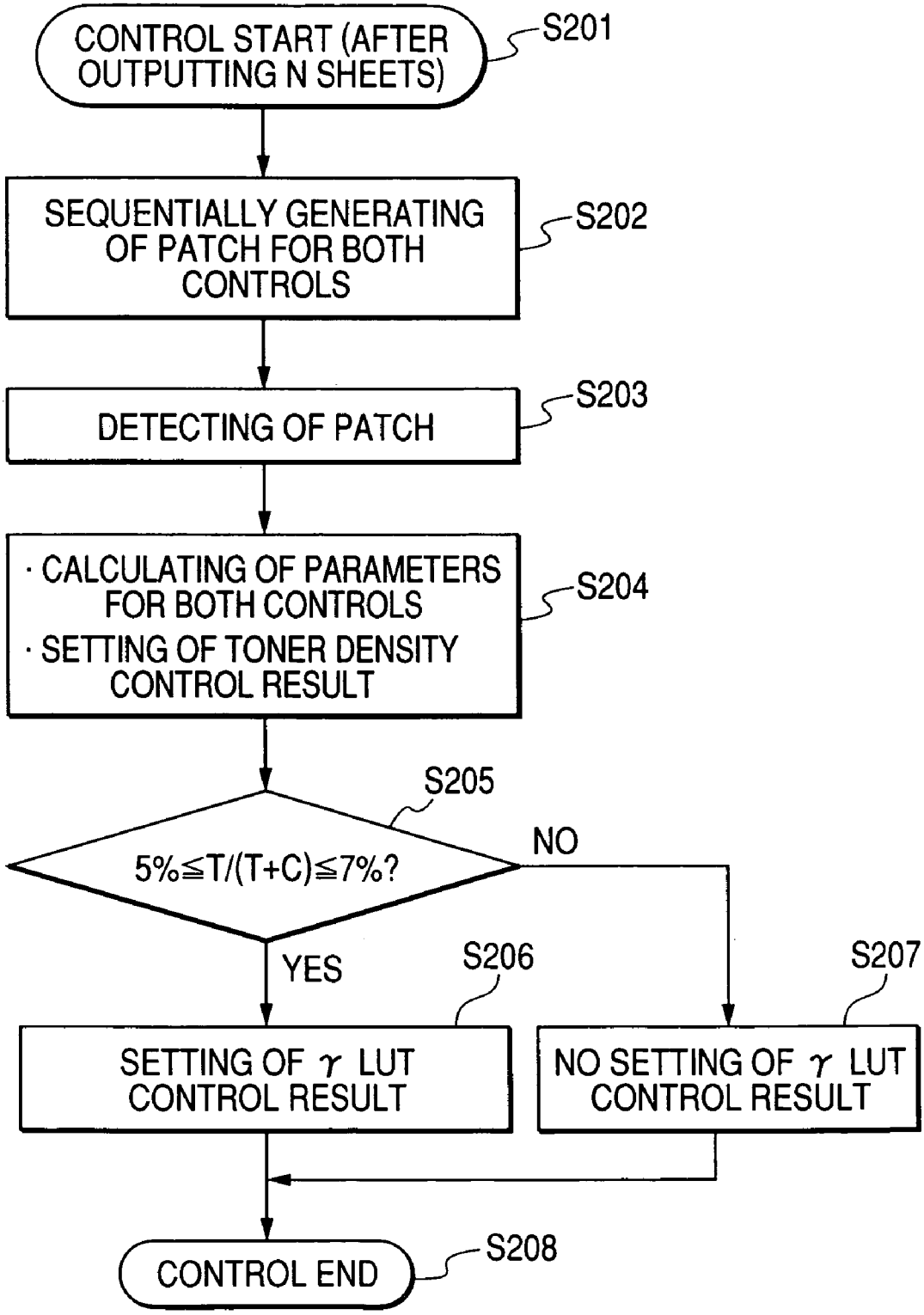
FIG. 7 is a flow chart showing a correlation of a toner concentration control and a density correction characteristic control (γLUT control)

In the following, there will be explained a correlated flow of the toner concentration control and the density correction characteristic control in the present embodiment, with reference to a flow chart shown in FIG. 7.

Figure 8:
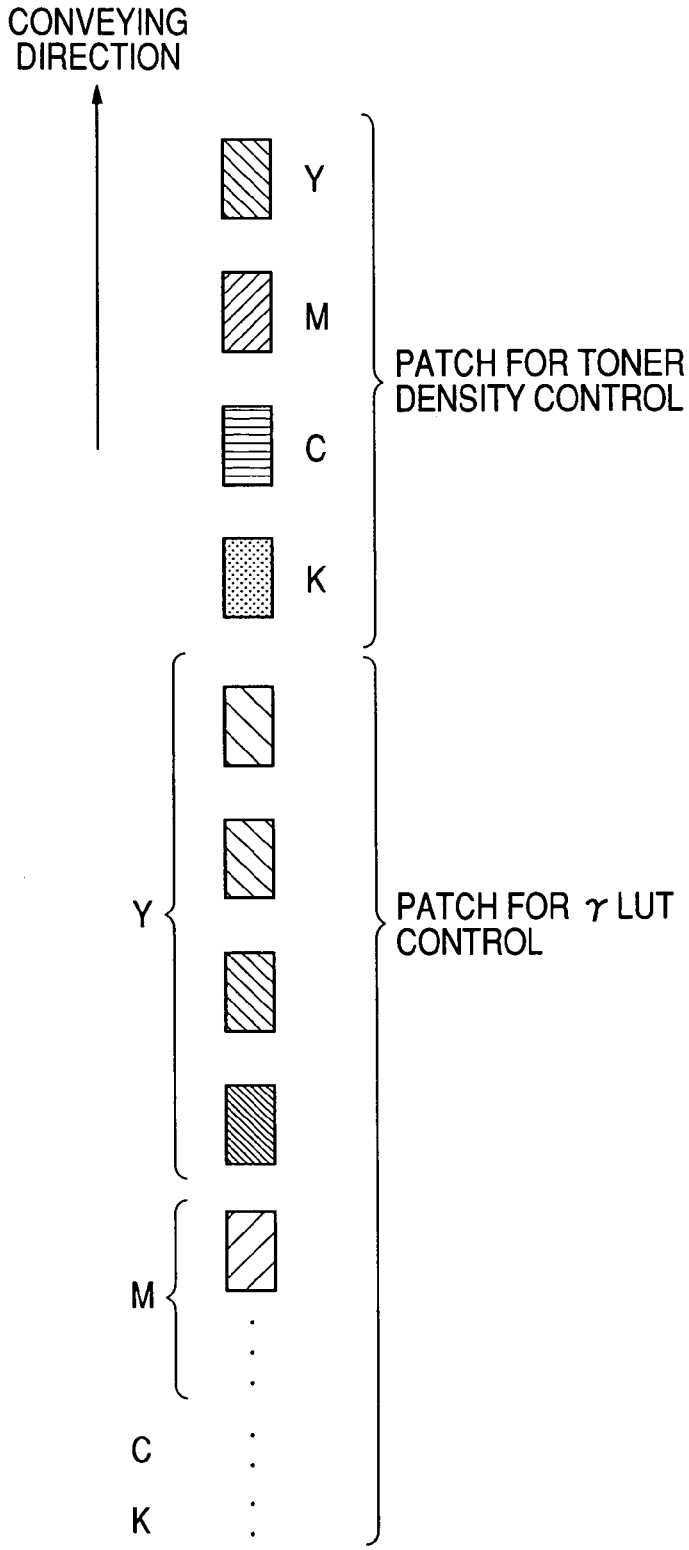
FIG. 8 is a schematic view showing a sample of patch images for both a toner concentration control and a density correction characteristic control (γLUT control).

After N image formations from the previous patch image formation, a toner concentration control and a density correction characteristic control are activated (S201). The printer engine portion 101 forms patch images for both the toner concentration control and the density correction characteristic control in succession as shown in FIG. 8, on the intermediate transfer belt 109 (S202). The densities of the patch images are detected by the density sensor 116 (S203). Then, in both the toner concentration control and the density correction characteristic control, calculations are made for setting various parameters based on the information of the patch images, and a result feedback is executed at first in the toner concentration control (S204).

Then the CPU 231, in case of judging that the toner concentration is 5 to 7% (S205), causes a feedback also of the result of the density correction characteristic control (S206), whereupon the control is terminated (S208). In this embodiment, an appropriate T/(T+C) ratio is selected as 6%.

On the other hand, in the present embodiment, a 1% deviation from such T/(T+C) ratio is considered as an aforementioned significant deviation of the toner concentration, and the correction of γLUT is not executed in such case. More specifically, the CPU 231, in case of detecting a toner proportion less than 5% or exceeding 7% to the developer, does not cause a feedback of the result of the density correction characteristic control to the correction of the γLUT. Therefore, in case the toner concentration is detected as less than 5% or exceeding 7%, the result of the density correction characteristic control is not fed back (S207) and the control is terminated.

In the foregoing description, the result of the toner concentration is used for judging whether or not to execute the feedback to the γLUT, but it is also possible use the result of the toner concentration for determining an amount of the feedback to the γLUT. It is possible, for example, to execute a feedback to the γLUT of 80% of a full feedback in case of a deviation in the toner concentration of 0.5%, a feedback of 50% in case of a deviation of 1% and a feedback of 10% in case of a deviation of 2%. In such case, in the above-described calculation of the correction value for γLUT in the level region 2, there can be multiplied a factor 0.8 (in case of 80% feedback), 0.5 (in case of 50% feedback), or 0.1 (in case of 10% feedback) respectively on the differences 1 and 2. In such configuration, in case of changing the level of the feedback according to the amount deviation in the toner concentration, such level of feedback can be suitably determined according to the characteristics of the image forming apparatus. In the present embodiment, therefore, the density correction characteristic control is corrected according to the result of detection of the toner concentration control patch. An embodiment in which no feedback of the result of the density correction characteristic control to the γLUT correction is executed in case the toner concentration control detects that the toner concentration is deviated beyond a predetermined range corresponds to a case of 0% feedback of the detection result of the toner concentration control patch on the density correction characteristic control.

In the present embodiment, as explained in the foregoing, the CPU 231 functioning according to the program stored in the ROM 232 functions, receiving the detection results of both the toner concentration control patch and the density correction characteristic control patch, correction means which corrects either control according to the detection result of the patch image for the other control. It is also possible not to activate the toner concentration control and the density correction characteristic control always at the same time but for example to activate the density correction characteristic control in every other activation of the toner concentration control. Namely there may be alternately executed a timing of forming only the toner concentration control patch and a timing of forming the patches for both controls in succession. Otherwise it is also possible to execute a formation of the patch images for both controls in every three or more formations of the patch image for the toner concentration control. In general terms, among the patch images for the first and second controls, the patch image for either control for every plural formations of the patch image for the other control. The present invention is characterized, in case of executing both controls, in forming the patch images for both controls in succession, and the frequency relationship between the toner concentration control and the density correction characteristic control may be determined according to the characteristics of the image forming apparatus.

Also in the present embodiment, the timing of executing the toner concentration control and the density correction characteristic control (γLUT preparation process) is selected for an every predetermined number of image outputs (every N image outputs), but the present invention is not limited to an embodiment where the execution timing for such controls is defined by a number of image outputs. Such controls may be executed for example at a preset timing, such as a predetermined time interval (for example an interval of 1 hour) after the turning-on of the power supply, or when an ambient temperature of a temperature of the printer shows a change exceeding a predetermined reference value.

Also in order to prevent a competition of the controls and to stabilize the image density, it is possible to correct the toner concentration control utilizing the result of the density correction characteristic control. In such case, it is necessary to control a variation in the T/(T+C) ratio so as not to deteriorate the image quality.

More specifically, there is adopted a configuration of giving a priority to the density correction characteristic control as means of correcting the image density, and suppressing a change in the image density by the toner concentration control. Such configuration provides a faster response, because the image density correction by the toner replenishment requires a certain time as an effect thereof becomes observable only after the developer is circulated for a certain amount, while the density correction characteristic control becomes effective as soon as the γLUT is changed. However, a toner concentration deviated from an appropriate value may cause image deteriorations such as a fog phenomenon showing a toner deposition on a white background or an enhanced graininess of the image. It is therefore necessary, even if the image density is at an appropriate level, to avoid the T/(T+C) ratio from going into an inappropriate range and to retain it in an appropriate range. Therefore, in a configuration of correcting the toner concentration control by the result of the density correction characteristic control, the feedback amount of the result of the density correction characteristic control to the toner concentration control cannot be made 0%, unlike the configuration of correcting the density correction characteristic control by the result of the toner concentration control. In the contemplated configuration, a feedback amount to the T/(T+C) ratio is reduced in case the density correction characteristic control shows a variation amount of γLUT equal to or less than a specified value. For example, the toner concentration control is corrected with a feedback amount of 50% according to the result of the density correction characteristic control. Otherwise, in case the variation amount of γLUT is equal to or less than a specified value, the feedback to the T/(T+C) ratio may be made stepwise. For example there may be adopted a configuration of executing a feedback of 50% at the control and executing a remaining feedback of 50% after N/2 (N being a positive number) image outputs. Such configuration allows to gradually correct the T/(T+C) ratio while maintaining the image density by the density correction characteristic control. Also in case the density correction characteristic control shows a variation amount of the γLUT equal to or larger than a specified value, the density correction characteristic control alone cannot provide a precise correction of the image density, so that a feedback amount to the T/(T+C) ratio is increased or may be selected as 10%.

As explained in the foregoing, the present embodiment allows to maintain the image density by a simple control of a short time.

The present invention may be applied to a system formed by plural equipment (such as a host computer, an interface equipment, a reader, or a printer) or to an apparatus formed by a single equipment (such as a copying apparatus of a facsimile apparatus). Also the objects of the present invention can be attained by supplying a system or an apparatus with a memory medium storing program codes of a software realizing the functions of the aforementioned embodiments, and reading and executing the program codes stored in the memory medium by a computer (or a CPU or an MPU) of such system or apparatus.

In such case, the program codes themselves read from the memory medium realize the functions of the aforementioned embodiments, and the program codes themselves or the memory medium storing the program codes constitutes the present invention.

The memory medium for supplying the program codes can be, for example, a floppy disk, a hard disk, an optical disk, a magnetooptical disk, a CD-ROM, a CD-R, a magnetic tape, a non-volatile memory card or a ROM.

The present invention includes not only a case where the functions of the aforementioned embodiments are realized by a computer by executing the read program codes, but also a case where an OS (operating system) or the like functioning on the computer executes all the processes or a part thereof under the instructions of the program codes, thereby realizing the functions of the aforementioned embodiments.

The present invention further includes a case where the program codes read from the memory medium are stored in a memory provided in a function expansion board inserted into the computer or a function expansion unit connected to the computer, and a CPU or the like provided in such function expansion board or the function expansion unit executes all the processes or a part thereof under the instructions of the program codes, thereby realizing the functions of the aforementioned embodiments.

The present invention has been explained by specific embodiments, but the present invention is not limited thereto but is subject to various modifications without departing from the spirit of the invention.

For example the image parameter capable of controlling the characteristic of the output image density is not limited to the toner concentration in the developer and the density correction characteristic control (γLUT). It is already known to those skilled in the art that the image density characteristic can be varied by a change in a charging condition for a photosensitive member for forming an electrostatic image (for example a charging voltage applied to charging means), an exposure condition of exposure means for exposing the photosensitive member (such as light amount), a transfer condition of the toner image onto the recording material (such as a transfer voltage applied to transfer means), or a developing condition of development means for supplying the electrostatic image with the developer (such as a developing voltage supplied to a developer carrying member). In particular, the second control means for executing the second control, different from the control (first control) on the toner concentration in the developer, may control, as an image parameter, at least one of such charging condition, exposure condition, transfer condition and development condition in addition to the density correction characteristic (γLUT).

Also in the foregoing it is assumed that the developer is a two-component developer including a toner and a carrier and that the toner concentration is represented by a T/(T+C) ratio. However the present invention is not limited to such configuration and the developer may be a single-component developer substantially constituted of toner only. In such case, the toner concentration in the developer is represented by a toner amount in the development means (developing device).

Also, as already known to those skilled in the art, there is available an image forming apparatus in which toner images formed on first image bearing members (such as photosensitive drums) in plural image forming stations are transferred in succession on a recording material carried on a recording material carrying member (such as a transfer belt) for conveying the recording material to the plural image forming stations and are fixed to obtain a recorded image. In such image forming apparatus, it is already known to form a control reference image (patch image) on the recording material carrying member serving as a second image bearing member, and to detect an image characteristic thereof by detection means such as a density sensor, thereby achieving a toner concentration control (first control) and a control (second control) on an image parameter different from the toner concentration, such as a density correction characteristic control. The present invention is likewise applicable to the image forming apparatus of such configuration.

Furthermore, the present invention is not limited to a configuration of detecting the image characteristic (such as toner deposition amount) of a control reference image (patch image) on an intermediate transfer member serving as a second image bearing member, or on a recording material carrying member. It is also possible to detect an image characteristic of a patch image (toner image), formed on a first image bearing member (such as a photosensitive drum) on which an electrostatic image is formed, on such first image bearing member. Also in such case, the objects of the present invention can be attained by forming patch images for both a toner concentration control (first control) and a control (second control) on an image parameter different from the toner concentration, such as a density correction characteristic control, in succession on the first image bearing member and correcting either control by a detection result of the other control.

There is also known an image forming apparatus having plural developing devices for a first image bearing member and (i) forming an image of developers of plural kinds (colors) on the first image bearing member and transferring such image onto a recording material, or (ii) transferring images of developers of plural kinds (colors), formed in succession on the first image bearing member, in succession and in superposition on a recording material conveyed on a recording material conveying member (such as a transfer belt) or on an intermediate transfer member (such as an intermediate transfer belt), and transferring such images onto a recording material, followed by a fixing to obtain a recorded image. Also in the image forming apparatus of such configuration, it is already known to form a control reference image (patch image) on the first image bearing member, the recording material bearing member as the second image bearing member, or the intermediate transfer member and to detect an image characteristic thereof by detection means such as a density sensor, thereby achieving a toner concentration control (first control) and a control (second control) on an image parameter different from the toner concentration, such as a density correction characteristic control. The present invention is also likewise applicable to the image forming apparatus of such configuration.

The present invention allows to maintain the image density stably by a simpler control of a shorter time.

This application claims priority from Japanese Patent Application No. 2004-266122 filed on Sep. 13, 2004, which is hereby incorporated by reference herein.

What is claimed is:

1. An image forming apparatus capable of forming, according to an image information signal, an image on an image bearing member with a developer containing a toner, and outputting the image by a transfer operation onto a recording material, the apparatus comprising;

detection means which detects an image characteristic of the image formed on the image bearing member;

first control means which controls a toner concentration in the developer, based on a detection result by the detection means, of an image characteristic of a first reference image for a first control for controlling the toner concentration in the developer;

second control means which controls an image parameter, different from the toner concentration in the developer, thereby controlling an image density, based on a detection result by the detection means, of an image characteristic of a second reference image for a second control, different from the first reference image for the first control; and correction means which receives detection results of both image characteristics of the first and second reference images, and which, based on the detection result of the image characteristic of either of the reference images for the first and second controls, corrects the other control.

2. An image forming apparatus according to claim 1, wherein the correction means corrects the second control based on the detection result of the image characteristic of the first reference image.

3. An image forming apparatus according to claim 2, wherein the correction means controls, based on the detection result of the image characteristic of the first reference image, a feedback amount of the detection result of the image characteristic of the second reference image in the second control.

4. An image forming apparatus according to claim 3, wherein the correction means shifts, upon detecting that the toner concentration in the developer is deviated from a predetermined value in excess of a predetermined range, based on the detection result of the image characteristic of the first reference image, to a zero feedback amount of the detection result of the image characteristic of the second reference image in the second control.

5. An image forming apparatus according to claim 1, wherein the second control controls, based on the detection result of the image characteristic of the second reference image, a density correction characteristic for correcting the image information signal in such a manner that the image density assumes a predetermined characteristic.

6. An image forming apparatus according to claim 1, wherein the second control controls, as the image parameter, at least one of a charging condition of a photosensitive member for forming an electrostatic image to be developed by the developer, an exposure condition of exposure means which exposes the photosensitive member, a transfer condition of the image to a recording material, and a developing condition of development means which supplies the developer to the electrostatic image.

7. An image forming apparatus according to claim 1, wherein the first reference image and the second reference image are formed in succession on the image bearing member.

8. An image forming apparatus according to claim 7, wherein the first reference image and the second reference image are formed simultaneously at a predetermined timing.

9. An image forming apparatus according to claim 7, wherein either of the first reference image and the second reference image is formed once while the other is formed a plurality of times.

10. An image control method for controlling an image density characteristic based on a detection result of an image characteristic of a reference image, formed on an image bearing member by a developer containing a toner according to an image information signal, the method comprising:

a step of detecting an image characteristic of a first reference image formed on the image bearing member for a first control for controlling a toner concentration in the developer;

a step of detecting an image characteristic of a second reference image, formed on the image bearing member and different from the first reference image, for a second control for controlling an image parameter different from the toner concentration in the developer thereby controlling the image density; and a step, after the detection of both image characteristics of the first and second reference images, of correcting, according to a detection result of the image characteristic of either of the reference images for the first and second controls, the other control.

11. An image control method according to claim 10, wherein the correcting step corrects the second control based on the detection result of the image characteristic of the first reference image.

12. An image control method according to claim 11, wherein the correcting step controls, based on the detection result of the image characteristic of the first reference image, a feedback amount of the detection result of the image characteristic of the second reference image in the second control.

13. An image forming method according to claim 12, wherein the correcting step shifts, upon detecting that the toner concentration in the developer is deviated from a predetermined value in excess of a predetermined range, based on the detection result of the image characteristic of the first reference image, to a zero feedback amount of the detection result of the image characteristic of the second reference image in the second control.

14. An image forming method according to claim 10, wherein the second control controls, based on the detection result of the image characteristic of the second reference image, a density correction characteristic for correcting the image information signal in such a manner that the image density assumes a predetermined characteristic.

15. An image forming method according to claim 10, wherein the second control controls, as the image parameter, at least one of a charging condition of a photosensitive member for forming an electrostatic image to be developed by the developer, an exposure condition of exposure means which exposes the photosensitive member, a transfer condition of the image to a recording material, and a developing condition of development means which supplies the developer to the electrostatic image.

16. An image forming method according to claim 10, wherein the first reference image and the second reference image are formed in succession on the image bearing member.

17. An image forming method according to claim 16, wherein the first reference image and the second reference image are formed simultaneously at a predetermined timing.

18. An image forming method according to claim 16, wherein either of the first reference image and the second reference image is formed once while the other is formed a plurality of times.

* * * * *

UNITED STATES PATENT AND TRADEMARK OFFICE

CERTIFICATE OF CORRECTION

PATENT NO. : 7,394,999 B2
APPLICATION NO. : 11/219734
DATED : July 1, 2008
INVENTOR(S) : Nobuhiko Zaima It is certified that error appears in the above-identified patent and that said Letters Patent is hereby corrected as shown below:

COLUMN 2:
Line 16, “However” should read --However,--.

COLUMN 4:
Line 59, “scan exposed” should read --scan-exposed--.

COLUMN 5:
Line 34, “mutually,” should read --in contact--.
Line 51, “Also” should read --Also,--.

COLUMN 10:
Line 35, “an” should be deleted.

COLUMN 13:
Line 45, “Also” should read --Also,--.

COLUMN 14:
Line 1, “Also” should read --Also,--.
Line 22, “following” should read --following,--.
Line 27, “am” should read --an--.

COLUMN 15:
Line 59, “use” should read --to use--.

COLUMN 16:
Line 4, “amount” should read --amount of--.
Line 28, “Namely” should read --Namely,--.

COLUMN 18:
Line 14, “example” should read --example,--.
Line 38, “However” should read --However,--.

COLUMN 19:
Line 44, “comprising;” should read --comprising:--.

UNITED STATES PATENT AND TRADEMARK OFFICE

CERTIFICATE OF CORRECTION

PATENT NO. : 7,394,999 B2
APPLICATION NO. : 11/219734
DATED : July 1, 2008
INVENTOR(S) : Nobuhiko Zaima It is certified that error appears in the above-identified patent and that said Letters Patent is hereby corrected as shown below:

COLUMN 21:

Line 3, "image forming method" should read --image control method--.
Line 11, "image forming method" should read --image control method--.
Line 17, "image forming method" should read --image control method--.

COLUMN 22:

Line 7, "image forming method" should read --image control method--.
Line 11, "image forming method" should read --image control method--.
Line 14, "image forming method" should read --image control method--.

Signed and Sealed this

Twenty-ninth Day of September, 2009

David J. Kappos

David J. Kappos
*Director of the United States Patent and Trademark Office*